US005351859A

United States Patent [19]

Jansen

[11] Patent Number: 5,351,859

[45] Date of Patent: Oct. 4, 1994

[54] DEVICE FOR REMOVING A FLUID FROM A CONTAINER

[75] Inventor: Adolf E. Jansen, Rotterdam, Netherlands

[73] Assignee: Dobart Holding B.V., Rotterdam, Netherlands

[21] Appl. No.: 894,070

[22] Filed: Jun. 5, 1992

[30] Foreign Application Priority Data

Jun. 7, 1991 [NL] Netherlands ..... 91 00980

[51] Int. Cl.[5] ..... B67B 7/00

[52] U.S. Cl. ..... 222/82; 222/83.5; 222/88; 222/400.7; 141/67; 141/330

[58] Field of Search ..... 222/88, 83.5, 82, 83, 222/400.7, 400.8; 141/67 R, 330 R, 329

[56] References Cited

U.S. PATENT DOCUMENTS

| | | | |
|---|---|---|---|
| 1,933,192 | 10/1933 | Taylor | 222/88 |
| 2,070,488 | 2/1937 | McIntosh | 222/88 |
| 2,536,221 | 1/1951 | Rector et al. | 222/88 |
| 2,655,286 | 10/1953 | Barbaro | 222/88 X |
| 3,092,106 | 6/1963 | Butler | 222/88 X |
| 3,358,883 | 12/1967 | Loe | 222/86 |
| 4,045,525 | 8/1977 | Huggins | 222/400.7 X |
| 4,081,006 | 3/1978 | Crowell et al. | 141/330 |
| 4,192,438 | 3/1980 | Foster et al. | 222/400.7 X |
| 4,846,403 | 7/1989 | Mivelaz | 222/82 X |
| 4,905,904 | 3/1990 | Ohara | 222/88 X |
| 5,071,035 | 12/1991 | Kiplinger | 222/91 X |

FOREIGN PATENT DOCUMENTS

| | | | |
|---|---|---|---|
| 0309612 | 4/1989 | European Pat. Off. . | |
| 0353855 | 2/1990 | European Pat. Off. . | |
| 6709543 | 1/1968 | Netherlands . | |
| 195734 | 5/1967 | U.S.S.R. | 222/88 |

OTHER PUBLICATIONS

Europees Octrooibureau Search Report, Jan. 1992, NL 91/00980, 3 pages.

*Primary Examiner*—Andres Kashnikow
*Assistant Examiner*—Anthoula Pomrening
*Attorney, Agent, or Firm*—Ladas & Parry

[57] ABSTRACT

A device for removing from a container a fluid contained therein comprises a needle-shaped member with a distal end that is suitable for piercing a septum that seals the container. The needle-shaped member is in connection with a discharge member for discharging the fluid removed from the container. At a proximal portion of the needle-shaped member, which portion is designed to be inserted into the container, at least one opening that is in open connection with the discharge member is provided.

5 Claims, 2 Drawing Sheets

DEVICE FOR REMOVING A FLUID FROM A CONTAINER

BACKGROUND OF THE INVENTION

The present invention is directed towards a device for removing from a container a fluid contained therein, said container being sealed by a septum, said device comprising a needle-shaped member with a distal end that is suitable for piercing the septum and a discharge member that is in connection with the needle-shaped member for discharging the fluid removed from the container.

Containers, e.g. in the shape of a bottle, comprising a septum, are used on a large scale for retaining fluid samples which originate e.g. from a chemical processing plant or from a human being or an animal. Receiving the fluid in the container and, if applicable, removing it again elsewhere for the sake of e.g. a chemical analysis of the sample, can be safely conducted by piercing the septum with a syringe, so that it is not necessary to remove a cap or lid first. In other words, the contents of the sample bottle remain sealed from the environment at all times. This safety issue is an important requirement, particularly if the fluid is aggressive and/or health-hazardous, or if a sterile environment has to be maintained, e.g. in hospitals.

When a syringe is used to remove fluid from the container, however, some fluid will always be left inside the container, and this fluid cannot be removed from the container as long as safety precautions are observed. This remaining fluid, or if not the entire sample was required for analysis, the rest of the fluid, is usually destroyed, e.g. by destroying the container with contents, which method puts an undesirable strain on the environment and is also a waste of material.

SUMMARY OF THE INVENTION

It is an object of the present invention to provide a device of the type referred to in the introduction, which allows nearly all the fluid retained in the container to be safely removed therefrom, for which the device according to the invention is characterized in that the needle-shaped member at a proximal portion thereof, designed to be inserted into the container, comprises at least one opening that is in open connection with the discharge member.

In this way it is possible to safely remove nearly all the fluid retained in the container via the at least one opening and to discharge it to e.g. a reservoir or to recycle it to the processing plant.

Further characteristics and advantages of the device according to the invention will become clear after reading the following description of a number of embodiments of the device according to the invention, wherein reference is made to the enclosed drawings, in which

DETAILED DESCRIPTION OF THE INVENTION

Figure 1:
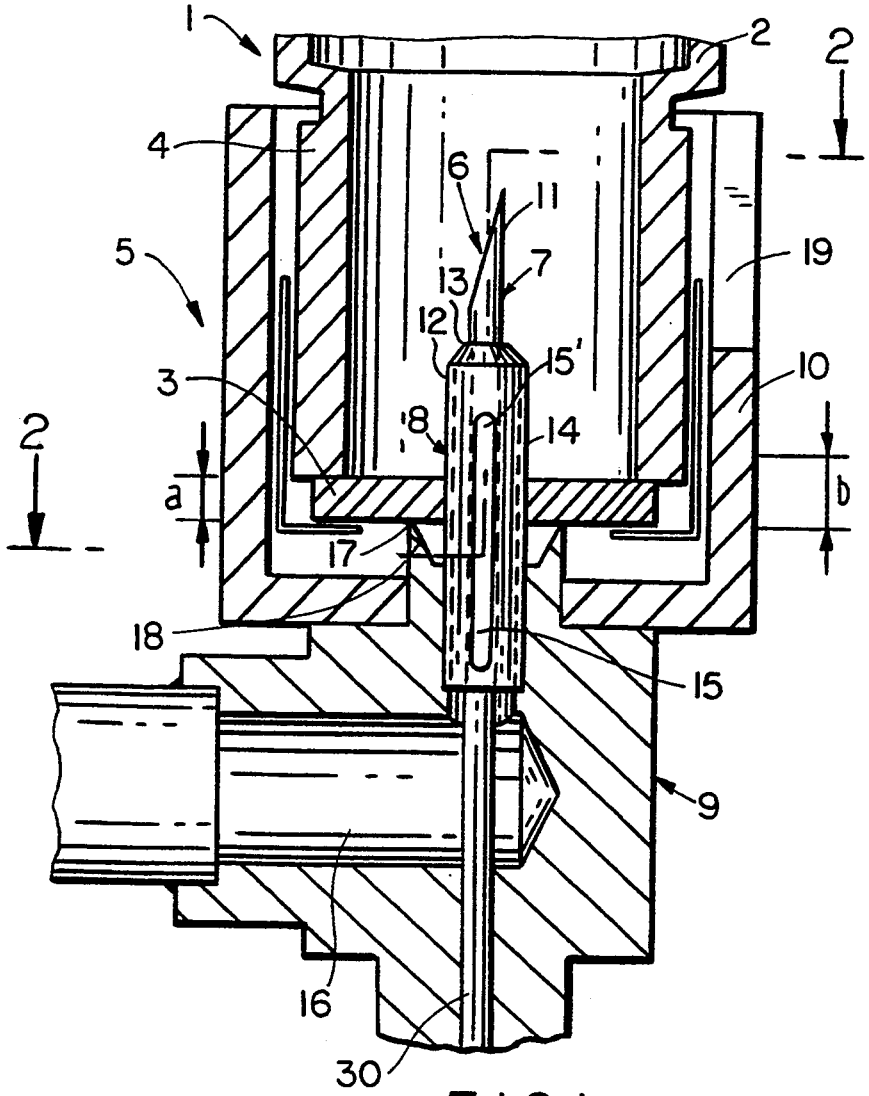
FIG. 1 schematically shows a view of a longitudinal section of a preferred embodiment of the device according to the invention.

In FIG. 1 a part of a container 1 is shown, having the shape of a bottle whose opening is sealed by a septum 3 and which is directed downwards with an upper portion 4 and which has been coupled to a device 5 according to the invention, which is shown in one of its preferred embodiments. The device 5 comprises a needle-shaped member 6 having in the shown preferred embodiment a first cylindrical part 7 and a second cylindrical part 8 which are coaxial with respect to one another and which have been incorporated in a support member 9. Parts 7 and 8 may have been integrally formed. The support member 9 comprises a receiving member 10 which is substantially cup-shaped and which surrounds the needle-shaped member 6. The cup-shaped receiving member 10 is of such dimensions that it is able to receive the container 1 with its upper portion 4, the container 1 being turned upside-down, so that the septum 3 of the container 1 is disposed as close as possible to the lowest point of the container when the container is in its received position.

Upon receiving the container 1 the septum 3 is pierced in a safe manner by the needle-shaped member 6. The receiving member 10 provides protection to the operator and facilitates the centering of the needle-shaped member 6 with respect to the septum 3. A recess 19 in the receiving member 10 offers a good view on the needle-shaped member 6 when the container is being placed upon the device.

The support member 9 furthermore has a plane of cooperation 17 for cooperation with a septum of a container, which plane of cooperation 17 is formed by an upturned edge 18 surrounding the needle-shaped member 6 and being bevelled at its inner periphery, and which allows the edge to slightly penetrate the septum 3 so as to provide a leakproof coupling.

The first cylindrical part 7 of the needle-shaped member 6 is longer than the second cylindrical part 8 and the first part has a smaller diameter. The part 7 is bevelled at a distal end 11 in order to facilitate the piercing of the septum 3 of the container 1. Taking the more or less elastic properties of the septum into account, the needle-shaped member 6 is at least long enough to pierce the septum. In the shown preferred embodiment the distal end 12 of the part 8 is tapered by an edge portion 13 linking up to the periphery of the part 7 so as to seal part 8 at least substantially.

In a proximal portion 14 of the cylindrical part 8 of the needle-shaped member 6, which portion 14 is designed to be inserted into the container 1, as shown, an axially extending slot has been applied on either side, said slot being in connection with a discharge member for discharging the fluid that is to be removed from the container, said discharge member having the form of a duct 16 provided in the support member 9.

Each slot 15 has been applied in such a manner that at least an opening portion 15' thereof, further indicated by a discontinuous line in FIG. 1, is situated at a distance b, measured in the axial direction of the cylindrical part 8, from the plane of co-operation 17, said distance b being substantially equal to but greater than the thickness a of the septum 3. Through at least this opening portion 15' of the slot 15 substantially all the fluid can be removed from the container 1 and discharged via duct 16 to e.g. a waste container.

As the slot 15 extends by a relatively great distance over the cylindrical part 8, positioning of the container 1 on the device 5 so that at least nearly all the fluid can be removed from the container, does not require great precision, and therefore the container can be placed on the device easily and quickly. In order to prevent fluid that would enter part 8 at its distal end 12 and thus be released via the slot 15 before positioning of the container is completed, the above-mentioned edge portion 13 seals the part 8 at least substantially.

In the shown embodiment the slot 15 extends beyond the upturned edge 18, so that while the fluid is in the process of being removed, fluid may also be found in a space defined by the septum 3, the upturned edge 18 and the cylindrical part 8.

Figure 2:
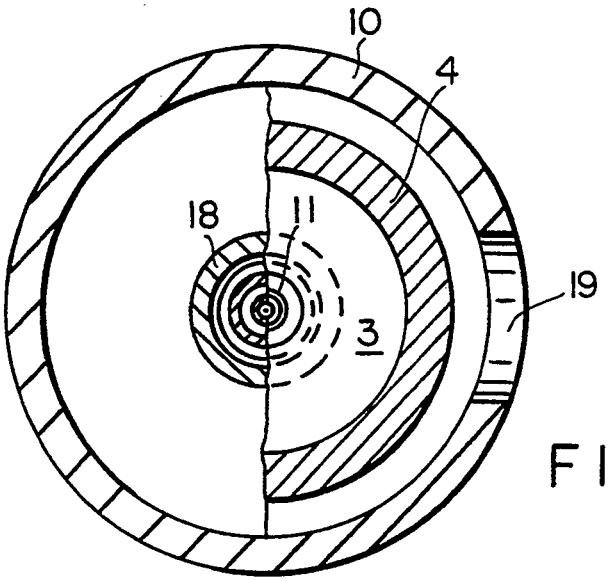
FIG. 2 shows a view of a longitudinal section of the device according to FIG. 1 along the line II—II.

FIG. 2 shows a view of a cross-section of the device according to FIG. 1 along the line II—II.

The cylindrical part 7 of the needle-shaped member 6 blends into gas supply member 30 for supplying a gas to the container when the fluid is being removed, as will be elucidated hereinafter on the basis of FIG. 3.

It should be noted that pressure means may have been provided, e.g. In the form of a swivelling clamp which engages the lower end of the container, so as to hold down the container, and particularly the septum, which is usually made of a resilient material, while the fluid is removed, against the support member 9 or, particularly, its upturned edge 18.

Figure 3:
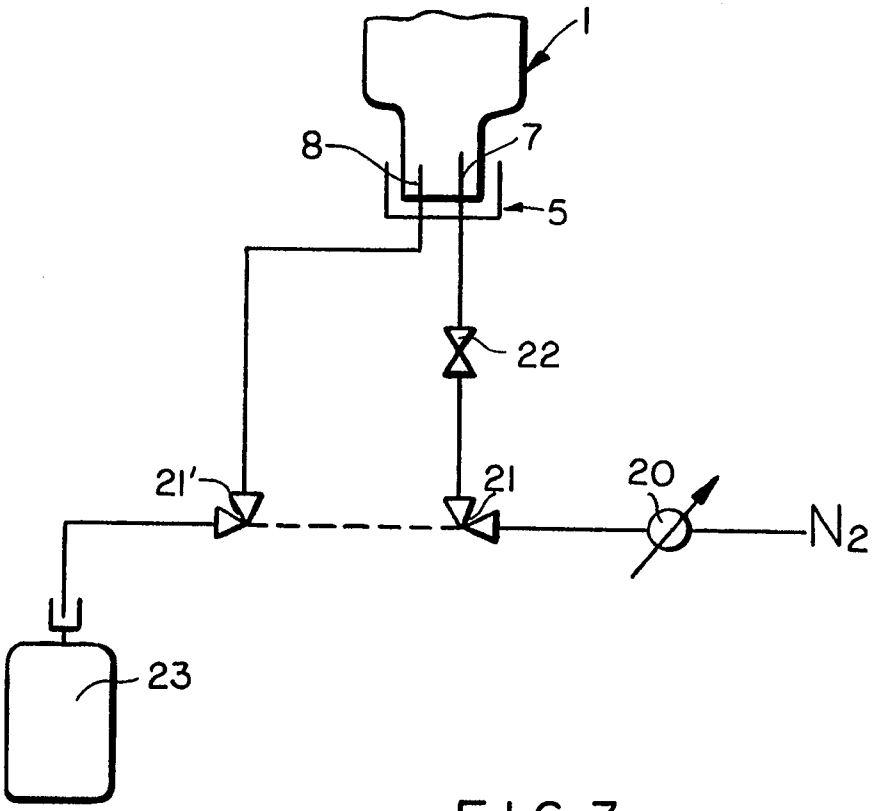
FIG. 3 shows a diagram of an arrangement in which a device according to the invention has been included.

FIG. 3 shows a diagram of an arrangement in which the device according to the invention has been incorporated in a processing plant. In the schematically represented device 5, in this case the cylindrical parts 7 and 8 of the needle-shaped member 6 are not disposed coaxially, but parallel to one another. In that case the two parts 7 and 8 are preferably both bevelled at their respective distal ends so as to pierce the septum of the container.

Via a pressure regulator 20, a two-way valve 21 and a return valve 22 that is integrally formed with the support member 9 of the device 5, and via the cylindrical part 7, gas is supplied to the container 1 in order to displace the fluid retained therein, said fluid being discharged via the slot applied in the cylindrical part 8 and a two-way valve 21' mounted further down the line, to a vessel 23 which is either a processing vessel or a waste vessel. If desired, a de-gassing unit may be provided, which is coupled to the vessel 23. Instead of or in addition to the vessel 23, a connection to a processing conduit may also be provided through a suitable coupling. Thus a quantity of fluid removed from a processing plant can be fed back to this plant or be fed to another plant.

Except to chemical processing plants, the device according to the present invention can also be applied to e.g. plants in the food industry, biochemical or pharmaceutical industry, in hospitals or in other places where it is important to remove the contents of containers in a safe manner prior to preparing those containers for reuse.

It should be noted that the above-described embodiments merely serve to illustrate the device according to the invention and that many changes can be made without stepping beyond the boundaries of the scope of the invention. The needle-shaped member 6 may e.g. be surrounded by an axially displaceable sleeve that is provided with a septum, the arrangement being so that the needle-shaped member, when the container is removed from the device, is surrounded by the sleeve and the said septum, so that the needle-shaped member can be flushed- Moreover, the parts 7 and 8, and particularly the distal ends 11 and 12 thereof, could be of a different design, e.g. without a bevel or without the edge portion 13, respectively.

I claim:

1. Device for removing a fluid from a container, said container being sealed by an elastic septum, said device comprising a support member for supporting the container, said support member having a plane of cooperation for cooperating with the septum, said support member having a needle-shaped member with a distal end for piercing the septum and penetrating into the container and a proximal end with an axially extending slot, said plane of cooperation being formed by an upturned edge surrounding the needle-shaped member, said slot comprising at least one opening, when the needle-shaped member penetrates into the container, said at least one opening being situated at a distance, measured in axial direction, from the plane of cooperation, wherein said distance is greater than the thickness of the septum, and said slot extending beyond the plane of cooperation, and said support member further comprising a discharge member being in open connection with said at least one opening for discharging the fluid from the container.

2. Device according to claim 1, wherein the upturned edge is bevelled at its inner periphery.

3. Device according to claim 1, wherein the slot extends beyond the upturned edge.

4. Device according to claim 1, wherein the needle-shaped member comprises a first cylindrical part and a second cylindrical part which is coaxial with the first cylindrical part, said first cylindrical part being in connection with a gas supply means, and being longer and having a smaller diameter than the second cylindrical part, the distal end of the needle-shaped member being formed by the first cylindrical part and the proximal end of the needle-shaped member being formed by the second cylindrical part.

5. Device according to claim 4, wherein the second cylindrical part has at its distal end an edge portion that connects to the circumference of the first cylindrical part.

* * * * *